United States Patent [19]

Shiga et al.

[11] 4,113,496

[45] Sep. 12, 1978

[54] DRY IMAGE FORMING MATERIAL

[75] Inventors: Tetsuo Shiga; Masaru Ozaki; Tatsumi Arakawa; Hidehiko Kobayashi, all of Fuji, Japan

[73] Assignee: Asahi Kasei Kogyo Kabushiki Kaisha, Osaka, Japan

[21] Appl. No.: 751,778

[22] Filed: Dec. 16, 1976

[30] Foreign Application Priority Data

Dec. 16, 1975 [JP] Japan ..... 50-149054
Feb. 19, 1976 [JP] Japan ..... 51-16528

[51] Int. Cl.[2] ..... G03C 1/02; G03C 3/00; G03C 5/24; G03C 1/76

[52] U.S. Cl. ..... 96/114.1; 96/67; 96/94 R; 96/48 HD

[58] Field of Search ..... 96/114.1, 114.6, 94 R, 96/67, 58, 108, 48 HD, 109, 107, 110

[56] References Cited

U.S. PATENT DOCUMENTS

| | | | |
|---|---|---|---|
| Re. 27,375 | 5/1972 | Puerckhauer et al. | 96/94 R |
| 3,772,031 | 11/1973 | Berry et al. | 96/108 |
| 3,794,488 | 2/1974 | Henn et al. | 96/114.1 |
| 3,811,885 | 5/1974 | Marchant et al. | 96/114.1 |
| 3,816,132 | 6/1974 | Takegawa et al. | 96/114.1 |
| 3,821,001 | 6/1974 | Weber | 96/114.1 |
| 3,887,597 | 6/1975 | Ohkubo et al. | 96/114.1 |
| 3,951,661 | 4/1976 | Soma et al. | 96/109 |
| 4,013,469 | 3/1977 | Haga et al. | 96/109 |

*Primary Examiner*—Dennis E. Talbert, Jr.
*Assistant Examiner*—L. Falasco
*Attorney, Agent, or Firm*—Burgess, Dinklage & Sprung

[57] ABSTRACT

A dry image forming material with an increased sensitivity, characterized by including a) an organic silver salt oxidizing agent, b) a reducing agent and c) a compound or a composition which comprises a halogen component and an organic component containing an element except for sulfur belonging to the IV group, V group or VI group of the periodic table and having an atomic number of 14 or more, and is adapted, by heating, to interact with the silver ion of a) to form a photosensitive interaction product. The dry image forming material according to this invention is of the type of post-activation and can be prepared, stored and handled under normal lighting conditions. The post-activation type dry image forming material according to this invention can be spectrally sensitized by incorporation of a sensitizing dye.

12 Claims, No Drawings

DRY IMAGE FORMING MATERIAL

This invention relates to a material which can record thereon a light-image in a short time and give a visible stable image only by dry process.

An object of the present invention is to provide a dry image forming material having an increased sensitivity which is non-photosensitive under normal lighting conditions but is rendered photosensitive by heating prior to image exposure. Another object of the present invention is to provide a dry image forming material of the kind described above which can be spectrally sensitized and is improved with respect to fog.

Silver halide photosensitive materials which have conventionally, widely been employed need complicated processes for the preparation thereof and the image formation therefrom. A considerable skill is thus needed to obtain a good result. For this reason, there have been many attempts to develop improved photosensitive materials which can be simply produced, or to make possible the production, storage and handling of a photosensitive image forming material in a light room. For example, heat-developable organic silver salt photosensitive materials are described in U.S. Pat. No. 3,457,075 and Japanese Patent Application Publication No. 26,582/1969. These materials contain a silver salt oxidizing agent comprising a silver salt of an organic compound such as behenic acid, benztriazole or the like, a catalytic amount of photosensitive silver halide and a reducing agent. However, these photosensitive materials have such defects that they should be prepared in a dark place and preserved in a cool dark place due to the poor storage stability and cannot be handled in a light room.

With a view to obviating the above-mentioned defects, it has been proposed in U.S. Pat. No. 3,802,888 that a film-forming thermoplastic binder is interveningly disposed between a layer of the source of halide ion and a layer of the organic silver salt oxidizing agent, the source of halide ion and the organic silver salt oxidizing agent being employed for forming a photosensitive halide. In such composition, however, the halide ion diffuses through the binder with the lapse of time and reacts with the organic silver salt oxidizing agent to form a photosensitive silver halide. This is proven by an increase of the fog observed when such a material is developed after several hours. The proposed photosensitive material is still insufficient to eliminate the above-mentioned defects.

Further, there has been proposed in U.S. Pat. No. 3,764,329 another improvement which makes possible the handling of a photosensitive material in a light room, e.g. under ordinary room light conditions. Such improvement consists in a sheet material which contains an organic silver salt oxidizing agent such as silver behenate or the like, an organic haloamide compound capable of forming photosensitive silver halide in cooperation with said organic silver salt oxidizing agent and a reducing agent for silver ion. The sheet material is non-photosensitive under normal lighting conditions but can be rendered photosensitive by preliminary heating for a short time. However, this sheet material has a defect, due to the organic haloamide employed therein, that its photosensitivity is low as compared with the above-mentioned photosensitive dry silver salt materials which originally contain the catalytic amount of silver halide itself in the photosensitive layer. This fact is also described in U.S. Pat. No. 3,707,377.

As a method for solving the problem, it is conceivable that a sensitizing dye is used to attain not only increase of the photosensitivity but also widening of the region of wave lengths of photosensitization. However, since a cationic sensitizing dye having halogen anion which is widely employed in conventional silver halide photosensitive materials forms a photosensitive silver halide only upon contact with an organic silver salt oxidizing agent, as described, for example, in the above-mentioned U.S. Pat. No. 3,457,075, it is unemployable for the material proposed in the above-mentioned U.S. Pat. No. 3,764,329.

Furthermore, in the case of a dry image forming material capable of being preserved in a light place as described in U.S. Pat. No. 3,764,329 and wherein an organic haloamide is employed as a halogenating agent for the formation of silver halide, even though a merocyanine dye which is generally useful as a sensitizing dye is employed, the dye is faded to lose the sensitizing function. It is thought as the reason that the organic haloamide compound bleaches the sensitizing dye and, as a result, the function of the dye as a spectral sensitizer is nullified. With respect to the above-mentioned defect, it may be referred to the description of U.S. Pat. No. 3,707,377 to the effect that an organic haloamide cannot be employed as an anti-foggant in a dye-sensitization type dry silver salt material.

Consequently, with respect to a dry image forming material which is non-photosensitive under normal lighting conditions but is rendered photosensitive by preliminary heating prior to image exposure (this type material will hereinafter be referred to as "post-activation type dry image forming material" in this specification), it is difficult to spectrally sensitize the material to the range of long wave lengths of the visible light by use of a spectral sensitizing dye which is widely employed in the conventional silver halide photosensitive materials.

As a result of our extensive and intensive investigations with a view to eliminating the defects of the conventional dry image forming materials, it has unexpectedly been found that a dry image forming material containing as main components an organic silver salt oxidizing agent, a reducing agent for silver ion and a compound or a composition which comprises a halogen component and an organic component containing an element except for sulfur belonging to the IV group, V group or VI group of the periodic table and having an atomic number of 14 or more and is adapted, by heating, to interact with said organic silver salt oxidizing agent to form a photosensitive interaction product, is extremely effective for obviating the defects of the post-activation type conventional photosensitive material. This invention has been made based on such novel finding.

According to the present invention, there is provided a post-activation type dry image forming material having an increased sensitivity as compared with the conventional dry image forming material of the same type. Besides, since a specific compound or composition (hereinafter referred to as "activating agent" in this specification) comprising a halogen component and an organic component containing an element except for sulfur belonging to the IV group, V group or VI group of the periodic table having an atomic number of 14 or more does not react with an organic silver salt oxidizing agent or the reaction, even if any, results only in formation of a non-photosensitive silver compound, a dry image forming material of this invention remains non-photosensitive under normal conditions. In the image forming material of the present invention, the silver ion of an organic silver salt oxidizing agent is caused to interact with said specific compound or composition by heating to yield a photosensitive interaction product. The image forming material of this invention is rendered photosensitive due to a photosensitive interaction product formed only by heating, as opposed to the conventional photosensitive material which is imparted with photosensitivity only due to a silver halide. The term "photosensitive interaction product" used herein is intended, as described above, to mean one produced by interaction between the specific compound or composition and the organic silver salt oxidizing agent. The structure of the photosensitive interaction product is not known exactly. However, it is presumed that the photosensitive interaction product may comprise a complex containing silver ion, a halogen and a specific element defined above, or a mixture containg silver ion, halogen and specific element components.

As the organic silver salt oxidizing agents to be suitably employed in this invention, there can be generally mentioned silver salts of long chain fatty acids having 12 to 24 carbon atoms, silver salts of organic compounds having 6 to 24 carbon atoms and containing an imino group and silver salts of organic compounds having 4 to 10 carbon atoms and containing a mercapto group or a thione group, which are well known, for example, from U.S. Pat. Nos. 3,457,075 and 3,764,329, Japanese patent application publication No. 26,582/1696 and Japanese patent application laid-open Nos. 134,421/1975 and 41,519/1976. Specific examples of such oxidizing agents include silver behenate, silver arachidate, silver nonadecanoate, silver stearate, silver heptadecanoate, silver palmitate, silver laurate, silver saccharinate, 5-substituted salicylaldoxime silver salt, benzotriazole silver salt, phthalazinone silver salt, 3-mercapto-4-phenyl-1,2,4-triazole silver salt, and the like. Silver behenate and silver arachidate are the most suitable. The above-mentioned oxidizing agents may be used alone or in mixture. The amount of an organic silver salt oxidizing agent may be in the range of about 0.1 to 50 g./m$^2$ (of a support having a dry image forming material applied thereon), preferably 0.5 to 10 g./m$^2$. These organic silver salt oxidizing agents may optionally include the organic acid components as such of the organic silver salts in a small amount.

As the reducing agents to be suitably employed in this invention, there can be mentioned substituted or unsubstituted bisphenols, substituted or unsubstituted naphthols, di- or polyhydroxybenzenes, hydroquinone ethers, ascorbic acids or its derivatives, 3-pyrazolidones, pyrazoline-5-ones, reducing sugars and the like, which are known as reducing agents from the above-mentioned U.S. Pat. specifications and the like. Specific examples of such reducing agents include hydroquinone, methylhydroquinone, chlorohydroquinone, bromohydroquinone, phenylhydroquinone, t-octylhydroquinone, t-butylhydroquinone, 2,5-dimethylhydroquinone, 2,6-dimethylhydroquinone, methoxyhydroquinone, methoxyphenol, hydroquinone monobenzyl ether, catechol, pyrogallol, resorcin, p-aminophenol, 2,4,4-trimethylpentyl-bis(2-hydroxy-3,5-dimethylphenyl)methane, bis(2-hydroxy-3-t-butyl-5-methylphenyl)methane, bis(2-hydroxy-3,5-di-t-butylphenyl)methane, 4,4'-methylenebis(2-methyl-6-t-butylphenol), 4,4'-methylenebis(2,6-di-t-butylphenol), 2,2'-methylenebis(6-t-butyl-4-ethoxyphenol), methylhydronaphthalene, phenidone, methyl gallate, lactose, ascorbic acid and the like. The above-mentioned reducing agents may be alone or in mixture. A suitable reducing agent may be chosen depending on the organic silver salt oxidizing agent employed in combination therewith. For example, when there is employed as the oxidizing agent a long chain fatty acid silver salt such as silver behenate which is relatively hard to reduce, a relatively strong reducing agent, e.g. a bisphenol such as 2,2'-methylenebis(4-ethyl-6-t-butyl)phenol is suitably employed. On the other hand, to organic silver salt oxidizing agents such as silver laurate which are relatively easy to reduce are suitable relatively weak reducing agents, e.g. substituted phenols such as p-phenylphenol and to organic silver salt oxidizing agents such as benzotriazole silver salt which are very hard to reduce are suitable strong reducing agents such as ascorbic acids. The amount of these reducing agents to be used may vary depending on the kind of the organic silver salt oxidizing agent used and the kind of the reducing agent to be used, but may generally be suitably in the range of about 0.1 to 5 moles per mole of the organic silver salt oxidizing agent used.

As the compounds which comprise a halogen component and an organic component containing an element except for sulfur belonging to the IV group, V group or VI group of the periodic table and having an atomic number of 14 or more and are adapted, by heating, to interact with the organic salt oxidizing agents to form photosensitive interaction products, there may be used compounds represented by the general formula (I) or (II):

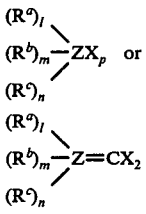

(I)

or (II)

wherein $R^a$, $R^b$ and $R^c$, which are different, each represent (1) a $C_1$–$C_{22}$ alkyl group, (2) a $C_1$–$C_{22}$ alkyl group substituted with a carboxyl group, a cyano group, a halogen group, an aryl group, a hydroxyl group, an amino group, or a mono- or di-($C_1$–$C_5$ alkyl)amino group (3) a $C_5$–$C_6$ cycloalkyl group, (4) a $C_5$–$C_6$ cycloalkyl group substituted with a $C_1$–$C_5$ alkyl group, a $C_1$–$C_5$ alkoxyl group, a halogen group, a hydroxyl group, an amino group, or a mono- or di-($C_1$–$C_5$ alkyl) amino group, (5) an aryl group (6) an aryl group substituted with a $C_1$–$C_5$ alkyl group, a $C_1$–$C_5$ alkoxyl group, a halogen group, a hydroxyl group, an amino group, a mono- or di-($C_1$–$C_5$ alkyl) amino group, (7) a group represented by $R_1$-$R_2$-, (8) a group represented by $R_1$-C≡C-, (9) a group represented by

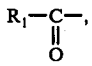

(10) a group represented by $$R_1-\underset{\underset{O}{\|}}{C}-R_2- \text{ or } R_6-\underset{\underset{O}{\|}}{C}-CH_2-\underset{\underset{O}{\|}}{C}-R_2-,$$

(11) a group represented by $R_3$—M—, $(R_3)_2P$- or $(R_3)_3M$-, (12) a group represented by —$R_4$—, —$R_5$—Y—$R_5$— or —$R_5$—$R_5$— which forms 5- or 6- membered ring with Z, [in the formulas of (9) to (12) above, $R_1$ is a hydroxyl group, a $C_1$–$C_5$ alkoxyl group, an unsubstituted or substituted 5- or 6- membered heterocyclic group having 16 or less carbon atoms and containing in its ring at least one oxygen and nitrogen, or a group defined in (1) to (7) above; $R_2$ is a $C_1$–$C_4$ alkylene group; $R_3$ is a group defined in (1) to (7) above; $R_4$ is a $C_1$–$C_5$ alkylene group unsubstituted or substituted with a $C_1$–$C_5$ alkyl group, a $C_1$–$C_5$ alkoxyl group, a mono- or di-($C_1$–$C_5$ alkyl)amino group, an amino group or a hydroxyl group; $R_5$ is the same as $R_4$ or a group represented by

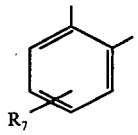

(wherein $R_7$ is hydrogen, a $C_1$–$C_5$ alkyl group, a $C_1$–$C_5$ alkoxyl group, a mono- or di-($C_1$–$C_5$ alkyl)amino group, an amino group, a hydroxyl group or a halogen group); M is tellurium, germanium, tin, lead or silicon; P is phosphorus; Y is oxygen, nitrogen, sulfur, M′ or =M′$X'_2$ (wherein M′ is the same as M and X′ is chlorine, bromine or iodine); and $R_6$ is a $C_1$–$C_5$ alkyl group]; X represents chlorine, bromine, or iodine; Z represents an element except for sulfur belonging to the IV group, V group and VI group of the periodic table and having an atomic number 14 or more; and *m* and *n* are 0 or a positive integer, and l and p are a positive integer, provided that in the general formula (I) above, $l+m+n+p=3$, 4 or 5 and in the general formula (II) above, $l+m+n+2=3$, 4 or 5. Compounds of the formula (I) wherein $l+m+n=2$, 3 or 4 or (II) wherein $l+m+n=2$ or 3 are especially preferred.

Preferred examples of specific elements represented by Z in the formula (I) or (II) include germanium, tin, lead, phosphorus, arsenic, antimony, bismuth, selenium, tellurium and polonium. Specific examples of the compounds of the formulas (I) and (II) include diphenyltellurium dichloride, diphenyltellurium dibromide, diphenyltellurium diiodide, bis(p-methoxyphenyl)tellurium dichloride, bis(p-methoxyphenyl) tellurium dibromide, bis(p-methoxypenyl) tellurium diiodide, bis(p-dimethylaminophenyl)tellurium dichloride, bis(p-tolyl) tellurium dibromide, di-n-butyltellurium dibromide, n-butylphenyltellurium dibromide, dimethyltellurium diiodide, dinaphthyltellurium dibromide, $$(C_3H_7\underset{\underset{O}{\|}}{C}-CH_2-\underset{\underset{O}{\|}}{C}-C_3H_6)_2TeBr_2,\ p\text{-}CH_3O-\underset{\underset{O}{\|}}{C_6H_4}-\overset{\overset{C_6H_5}{|}}{TeBr_2},$$

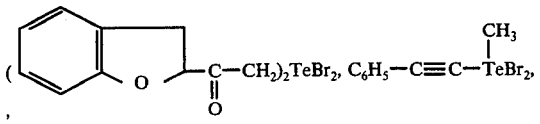

-continued

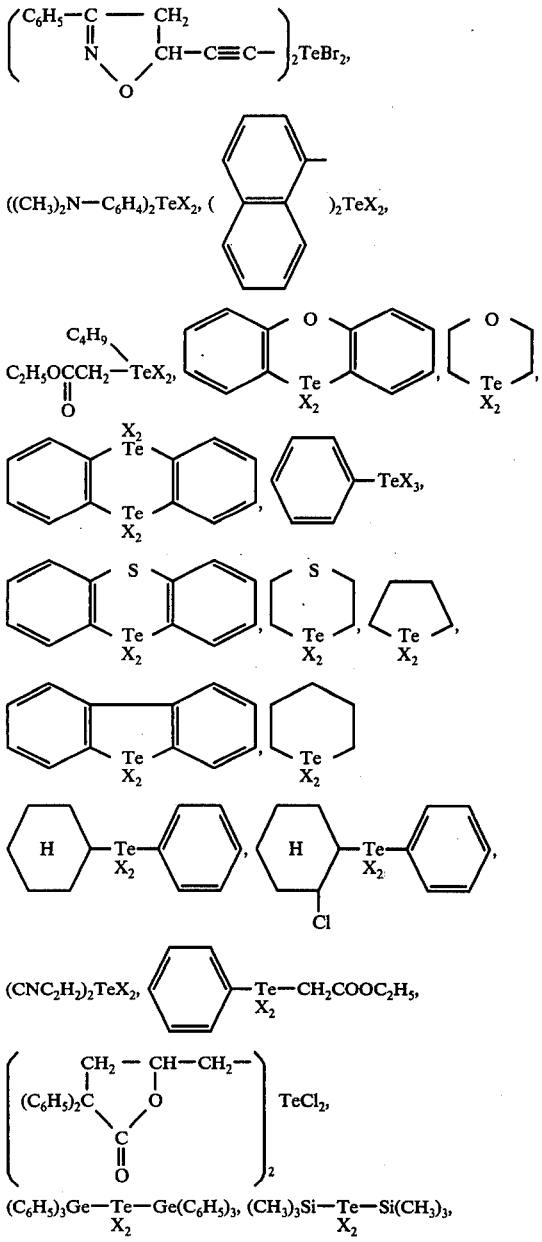

$(C_6H_5)_3Ge-\underset{X_2}{Te}-Ge(C_6H_5)_3$, $(CH_3)_3Si-\underset{X_2}{Te}-Si(CH_3)_3$, triphenylgermanium chloride, triphenylgermanium bromide, dibenzyltin dichloride, triphenyltin bromide, triphenylbismuth dichloride, triphenylbismuth dibromide, triphenylbismuth diiodide, tris(p-methoxyphenyl)bismuth dibromide, triphenylphosphine dibromide, triphenylphosphine dibromomethylene, phenyldichloroarsine, tetraphenylarsine chloride, phenyldibromoarsine, tetraphenylarsine bromide, triphenyllead bromide and the like. In the above formulas showing the specific compounds, X is chlorine, bromine or iodine. These compounds may be used alone or in mixture and in an amount of 0.005 to 0.5 mole, preferably 0.01 to 0.1 mole per mole of the organic silver salt oxidizing agent.

As the organic component containing a specific element defined before and constituting the aforementioned composition, there may be used a compound represented by the general formula (III)

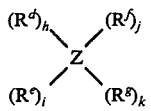

(III)

wherein $R^d$, $R^e$, $R^f$ and $R^g$ have the same meaning as $R^a$, $R^b$ and $R^c$ except that in the definition of (12) above, Y represents oxygen, nitrogen, sulfur and M'; and h is a positive integer, and i, j and k are 0 or a positive integer, provided that h+i+j+k=2, 3 or 4. Specific examples of the compounds of the formula (III) include triphenylphosphine, tris(p-N,N-dimethylaminophenyl)phosphine, trimethylarsine, triphenylarsine, tri-n-butylantimony, triphenylantimony, trimethylbismuth, triphenylbismuth, diethyl selenide, dimethyl selenide, diphenyl selenide, bis(p-methoxyphenyl)selenide, diethyl telluride, diphenyl telluride, bis(p-tolyl)telluride, bis(p-methoxyphenyl)telluride, n-butyl phenyl telluride, $(C_6H_5)_3Ge\text{-}Te\text{-}Ge(C_6H_5)_3$, $(C_6H_5)_3Ge\text{-}Te\text{-}Sn(C_6H_5)_3$, $(C_6H_5)_3Ge\text{-}Te\text{-}Pb(C_6H_5)_3$, $(C_6H_5)_3Sn\text{-}Te\text{-}Sn(C_6H_5)_3$, $(C_6H_5)_3Sn\text{-}Te\text{-}Pb(C_6H_5)_3$,

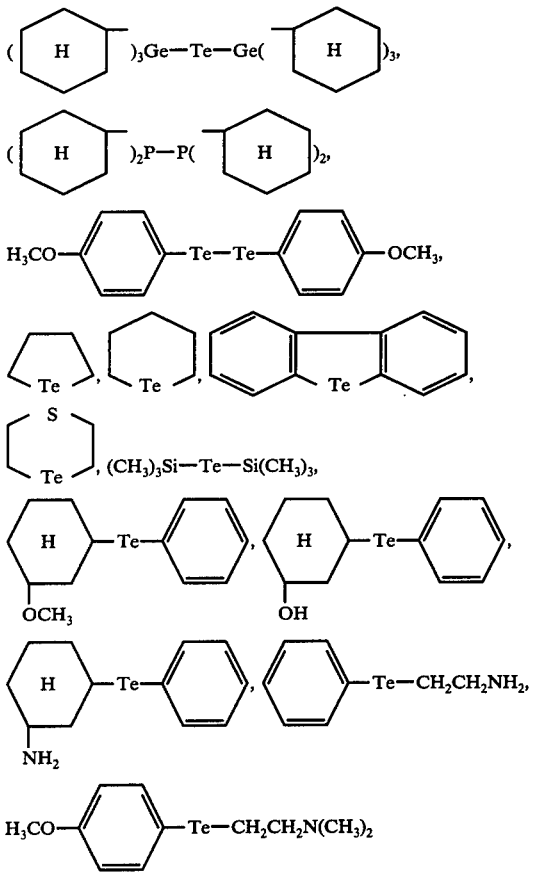

and the like. The compounds may be used alone or in mixture.

As the halogen component constituting the aforementioned composition may be used, for example, an organic haloamide compound which has the essential structure —CONX— or —$SO_2$NX— wherein X is chlorine, bromine or iodine. Specific examples of the organic haloamide compounds include N-bromosuccinimide, N-chlorosuccinimide, N-iodosuccinimide, N-bromophthalimide, N-bromoacetamide, N-bromoacetanilide, N-bromophthalazinone, 1-bromo-3,5,5-trimethyl-2,4-imidazolidinedione, 1,3-dibromo-5,5-dimethyl-2,4-imidazolidinedione, N,N,-dibromobenzenesulfonamide, N-bromo-N-methylbenzenesulfonamide, 1,3-dibromo-4,4-dimethylhydantoin, potassium salt of dibromoisocyanuric acid, trichloroisocyanuric acid and the like. These compounds may be used alone or in mixture.

The compounds of the formula (III) and the haloamide compounds may be simply mixed to form the composition to be employed in this invention. The organic compound of the formula (III) may preferably be employed in an amount of 0.5 to 1.1 moles per mole of the organic haloamide compound. The organic haloamide compound may preferably be employed in an amount of about 1 to 10% by weight based on the organic silver salt oxidizing agent.

In order that the sensitivity of a dry image forming material of the present invention may be remarkably increased, there may advantageously be employed a tellurium-containing compound such as bis(p-methoxyphenyl)tellurium dichloride, bis(p-methoxydiphenyl)tellurium dibromide, bis(p-methoxyphenyl) tellurium diiodide, dimethyltellurium diiodide or bis(p-methoxyphenyl)telluride, or a tellurium-containing composition such as a mixture of bis(p-methoxyphenyl)telluride and N-bromosuccinimide.

Various kinds of binders known in this field can be used as a binder for a dry image forming material of this invention. For example, there can be mentioned polyvinyl butyral, polyvinyl formal, polyacrylamide, polymethyl methacrylate, polystyrene, polyvinyl acetate, cellulose acetate, cellulose acetate propionate, polyvinyl pyrrolidone, polyvinyl chloride, polyisoprene, butadiene-styrene copolymer, vinyl chloride-vinyl acetate copolymer, polyvinyl alcohol or the like. They may be used alone or in mixture, and in an amount of about 10:1 to 1:10 by weight based on the organic silver salt oxidizing agent. When the organic silver salt oxidizing agent or the reducing agent has the function as a binder, use of the binder may be omitted.

A wide variety of supports can be employed as a support for a dry image forming material of this invention. Representative examples include a polyester film, a polystyrene film, a polycarbonate film, a cellulose ester film, glass and paper.

Furthermore, in this invention, other components such as a toner for silver image and an anti-foggant may optionally be emloyed. Phthalazinone, mercury acetate, tetrabromobutane and the like are useful as such agents.

The preparation of a dry image forming material of this invention is outlined as follows. An organic silver salt oxidizing agent is dispersed in a binder by an ordinary method such as ball-milling to form an emulsion of the organic silver salt oxidizing agent. Into the emulsion are mixed other components of this invention, namely an activating agent and a reducing agent, as well as other additives such as a toner and an anti-foggant to obtain a liquid. The thus prepared liquid is applied onto a support by an ordinary method to form an image forming material layer. Alternatively, a liquid containing, for example a reducing agent and a toner and another liquid containing, for example an organic silver salt oxidizing agent and an activating agent may be separately prepared and applied onto a support. The thickness of the image forming material layer may be 1 to 1,000μ, preferably 3 to 20μ. A polymer layer may further be provided on the image forming material layer for improvement of transparency of the image forming material layer and preservability of the raw film and for protection of the image produced. As polymers suitably employable, there can be mentioned polyvinyl butyral, polyvinyl formal, cellulose acetate, methyl methacrylate, polystyrene, polyurethane, polyvinyl chloride, polyvinyl acetate, polyvinyl pyrrolidone, polycarbonate, polyvinylidene chloride and the like. The thickness of the polymer layer is suitably about 1 to 10$\mu$.

In another aspect of this invention, as mentioned above, there is provided a dry image forming material which can be spectrally sensitized and is improved with respect to fog. As described, the conventional post-activation type dry image forming materials containing an organic haloamide compound are impossible to spectrally sensitize. According to this invention, however, when a sensitizing dye is added in the form as adsorbed on the organic silver salt oxidizing agent, the present post-activation type dry image forming material is spectrally sensitized to widen the region of wave lengths for photosensitization. On the other hand, a dry silver salt photosensitive material containing a sensitizing dye is generally liable to bring about fog as a silver halide photosensitive material is. But, according to another aspect of this invention, the occurrence of fog also can be remarkably prevented, even though a sensitizing agent is incorporated in the present image forming material. The prevention of occurrence of fog is due to the fact that substantially all of the sensitizing dye is adsorbed on the organic silver salt oxidizing agent. The absorption of a sensitizing dye on the organic silver salt oxidizing agent may be realized by effecting conversion of the precursor of the organic silver salt oxidizing agent to the organic silver salt oxidizing agent in the presence of the sensitizing dye to cause the sensitizing dye to be adsorbed in the micelles which are formed by association of the molecules of the organic silver salt oxidizing agent, or by dispersing the organic silver salt oxidizing agent in a solution of a sensitizing dye to cause the sensitizing dye to be adsorbed on the aggregates which are formed by gathering of associates of the molecules of the organic silver salt oxidizing agent, followed by removal of the free non-adsorbed sensitizing dye. Due to such adsorption the occurrence of fog can be remarkably prevented.

Illustrative explanation is made on the former case of adsorption. The above-mentioned "precursor" of the organic silver salt oxidizing agent means the one-stage-preceding compound of the organic silver salt oxidizing agent in the reaction of forming the organic silver salt oxidizing agent. For example, in case silver behenate is formed by the reaction between sodium behenate and silver nitrate, the sodium behenate is referred to as the precursor of the organic silver salt oxidizing agent. As described in U.S. Pat. No. 3,457,075, the molecules of the organic silver salt oxidizing agent in this invention have their hydrophilic polar silver ions oriented toward each other and associated together and surrounded by the organic radicals in the molecule of the organic silver salt oxidizing agent to form micelles being separated from other adjacent associates. Several of these micelles of the organic silver salt oxidizing agent usually gather together to form aggregates. When the precursor of an organic silver salt oxidizing agent is converted to the organic silver salt oxidizing agent in the presence of a sensitizing dye to form micelles of the molecules of said organic silver salt oxidizing agent, the sensitizing dye is adsorbed on the polar silver ion portion of the molecule of said organic silver salt oxidizing agent so that the molecules of said sensitizing dye are confined in said micelles. The adsorbed sensitizing dye is not removed even though washed by a solvent containing no halogen and capable of dissolving said dye. It is believed that the so adsorbed sensitizing dye has an extremely high efficiency of sensitization as compared with the free sensitizing dye present in the micelle of said organic silver salt oxidizing agent without being adsorbed.

In the latter case of adsorption, the adsorption is attained by dispersing an organic silver salt oxidizing agent in a solution of a sensitizing dye, separating the organic silver salt oxidizing agent having the dye adsorbed thereon and removing the non-adsorbed portion of the dye by a solvent capable of dissolving said dye, whereby the sensitizing dye is adsorbed on the aggregates which are formed by gathering of associates of the molecules of the organic silver salt oxidizing agent. In this case, it is believed that the sensitizing dye is diffused in the micelles of the organic silver salt oxidizing agent.

The term "adsorption" used herein is intended to mean the state when the sensitizing dye adsorbed on an organic silver salt oxidizing agent is no longer extracted by a solvent.

On the other hand, the occurrence of fog in the silver halide photograph is elucidated to be caused by electron migration to the photosensitive silver halide through transition, on acquirement of energy, from the ground state to the excited state of the sensitizing dye. It is believed that the adsorbed sensitizing dye may be energetically stabilized by adsorption as compared with the free non-adsorbed dye, and hence fog by heat which is generally liable to occur at the time of heat developemnt extremely reduced.

It is generally known in the photographic chemistry of silver halide that the stronger the adsorption of a sensitizing dye adsorbed on the silver halide, the more the fog. However, it has surprinsingly been found that in the dry image forming material of this invention the adsorption of a sensitizing dye causes fog to be rather reduced. The reason is not known exactly but believed to be as follows.

When a sensitizing dye is adsorbed on a silver halide conventionally employed, the energy level of the sensitizing dye is lowered by the adsorption stabilization. But, on the other hand, the barrier potential of electron migration to the silver halide through transition from the ground state to the excited state of the sensitizing dye is simultaneously lowered. The degree of the lowering of this barrier potential is larger than that of the lowering of the ground state level of the sensitizing dye, and therefore fog is liable to occur. In contrast, in this invention, the adsorption of a sensitizing dye occurs partially in polar silver ions in the micelle, and a photosensitive silver compound will be formed with high probability from other silver ion part in the same micelle than the silver ion part where said sensitizing dye is adsorbed. Accordingly, in the image forming material of this invention a sensitizing dye in the micelle of the organic silver salt oxidizing agent is adsorbed not in such a manner that the sensitizing dye is adsorbed on silver compound as in the general silver halide photograph, that is, the sensitizing dye is not directly adsorbed on a photosensitive silver compound. Therefore, the degree of lowering of the barrier potential of electron migration to the photosensitive silver compound from the sensitizing dye is extremely small as compared with the degree of stabilization due to the adsorption of the sensitizing dye on the silver ion part of the organic silver salt oxidizing agent. As a result, in the present invention the occurrence of fog is caused to be reduced by the adsorption of a sensitizing dye on the organic silver salt oxidizing agent. Only according to the present invention, increase of sensitivity and reduction of fog can be simultaneously attained by the adsorption of a sensitizing dye. This is a very surprising effect which is unimaginable from the photographic chemistry of silver halide.

Any kind of sensitizing dye may be employed in this invention so far as it has a structure containing no halogen anion. As typical examples, there can be mentioned merocyanine type dyes, styryl type dyes and acid dyes such as Erythrocin, Eosine, fluorescein and the like. Which are well known in this field. Merocyanine type dyes are especially preferred.

As merocyanine type sensitizing dyes, for example, the following compounds can be mentioned.

1

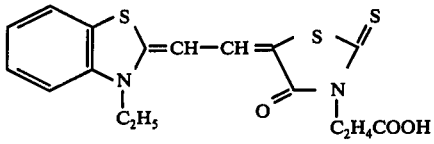

2

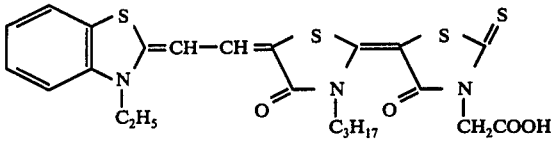

3

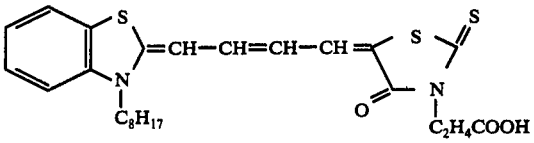

4

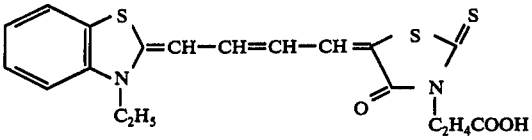

5

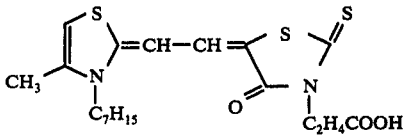

6

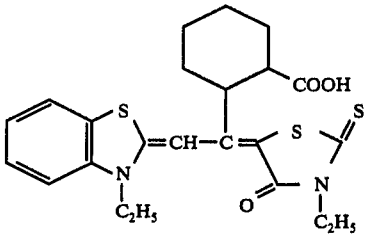

7

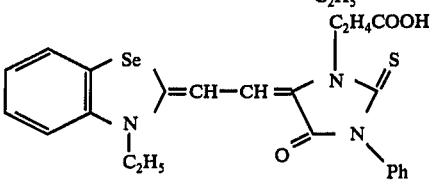

-continued

8

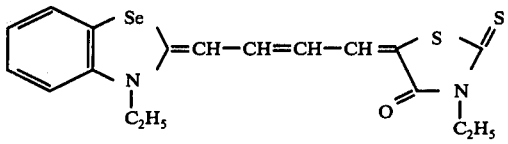

9

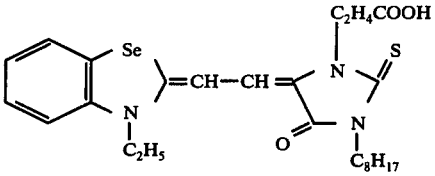

10

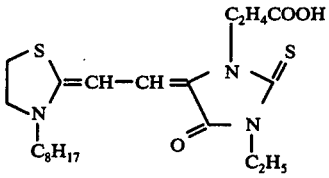

11

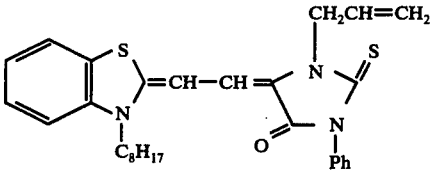

12

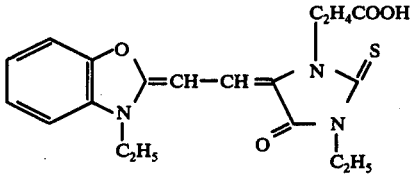

13

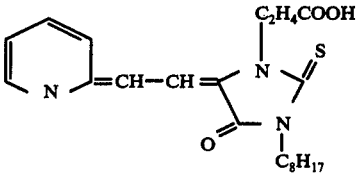

14

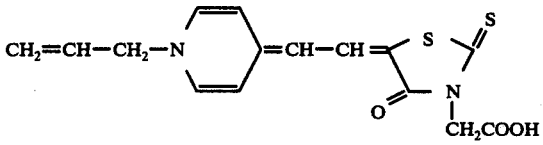

15

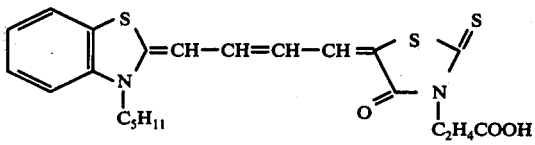

16

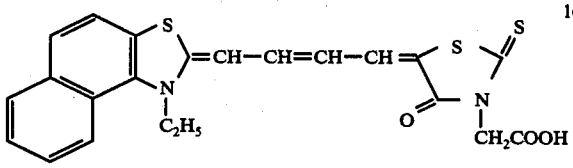

17

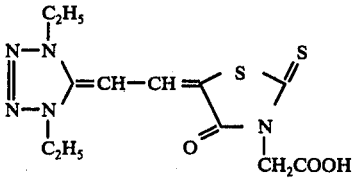

-continued

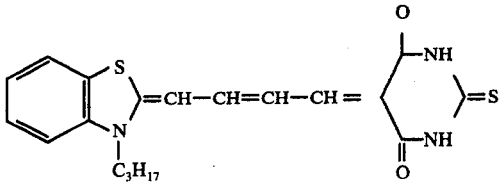

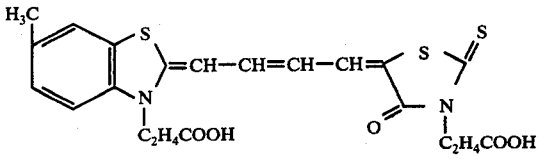

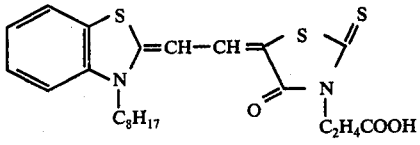

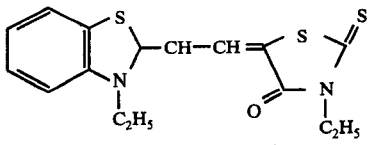

As styryl type sensitizing dyes, for example, the following compounds can be mentioned.

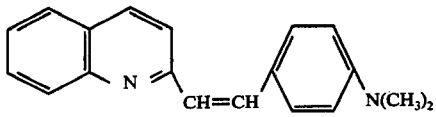

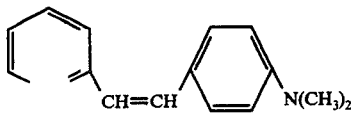

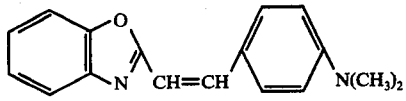

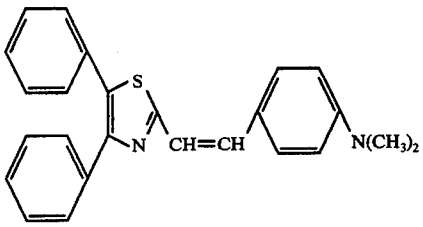

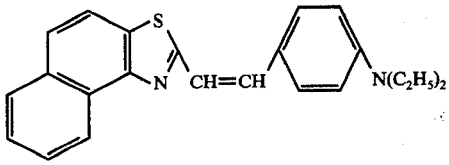

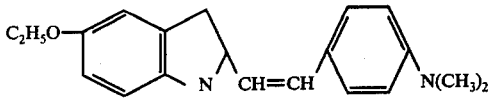

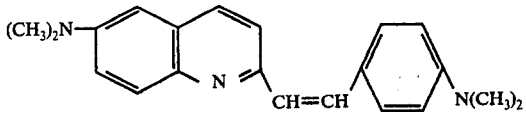

-continued

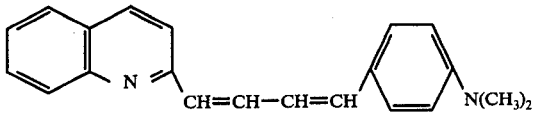

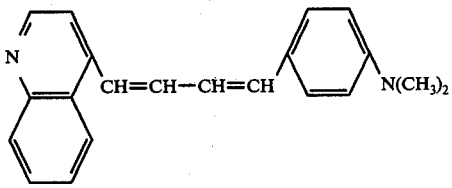

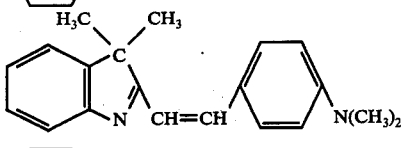

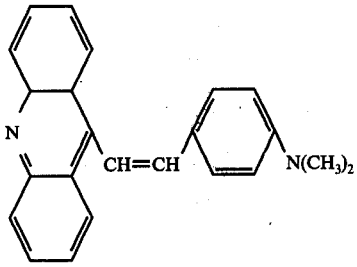

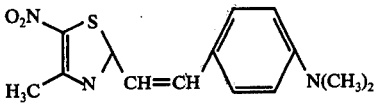

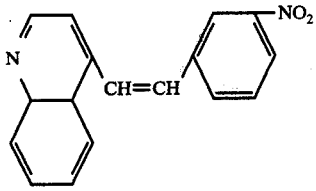

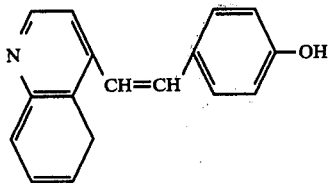

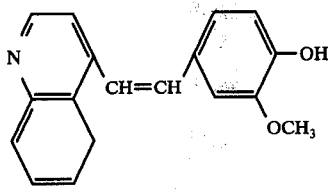

The amount of the sensitizing dye to be used is suitably about $10^{-6}$ to $10^{-2}$ mole per mole of the organic silver salt oxidizing agent.

In this invention, a preferred sensitizing dye is of a structure containing a carboxylic acid group or its salt. A sensitizing dye of a structure containing a higher alkyl group having a carbon number of 6 or more is also suitable. A sensitizing dye having a structure containg both of them may also be employed. Further, it is noted that in the method in which the precursor of an organic silver salt oxidizing agent is converted to the organic silver salt oxidizing agent in the presence of a sensitizing dye, it is suitable to employ a dye having a structure in which heterocycles are bonded through a ethylidene type group.

Methods for adsorbing substantially all of the sensitizing dye on an organic silver salt oxidizing agent are now explained. One method consists in that the precursor of an organic silver salt is converted to said organic silver salt oxidizing agent in the presence of a sensitizing dye. Another method consists in that particles of the organic silver salt oxidizing agent are uniformly dispersed in a sensitizing dye solution, and then the dye not adsorbed on the aggregates of the organic silver salt oxidizing agent is removed using a solvent.

The first method will be explained in more detail. A compound having hydrogen in place of the silver of an organic silver salt, e.g. a long chain fatty acid, is dissolved in an organic solvent capable of dissolving said compound, e.g. ethanol or the like. An aqueous solution of an alkali metal ion, e.g. an aqueous sodium hydroxide solution is then added. There is prepared a solution of the precursor of the organic silver salt oxidizing agent, e.g. an alkali metal salt of the long chain fatty acid. Subsequently, a sensitizing dye is dissolved in the above-mentioned solution. To the thus obtained solution is added an aqueous solution of a water-soluble silver salt such as silver nitrate or the like. The organic silver salt oxidizing agent with the sensitizing dye adsorbed thereon is thus obtained. The free sensitizing dye not adsorbed on the organic silver salt oxidizing agent is removed by washing the above obtained organic silver salt oxidizing agent with a solvent containing no halogen and capable of dissolving the sensitizing dye. For example, the process for the preparation of silver behenate as the organic silver salt oxidizing agent may be practiced as follows. Behenic acid is dissolved in warm ethanol and an equimolar amount of sodium hydroxide is added to yield sodium behenate. Hot water is then added to dissolve sodium behenate and a sensitizing dye is further added and dissolved. Subsequently, an aqueous solution containing an equimolar amount of silver nitrate is dropwise added with stirring. Silver behenate precipitates. The thus obtained precipitate is sufficiently washed with warm water and hot ethanol to remove the by-products such as sodium nitrate and unreacted materials. Even if the free non-adsorbed dye is present, it can simultaneously be removed by the above-mentioned treatment. Occasionally, washing with methyl ethyl ketone or acetone may be preferably conducted. Subsequent heating under reduced pressure gives the desired product with the sensitizing dye adsorbed in the micelles of silver behenate.

When the obtained silver behenate is washed, as mentioned above, with warm water and hot ethanol, or, occasionally, further with methyl ethyl ketone or acetone, the free non-adsorbed dye is dissolved and removed into the washings in the early stage of washing, and the washings are colored by the dye dissolved therein. The continuation of washing will give uncolored washings. On the other hand, the silver behenate is colored due to the adsorption of the dye. This fact clearly shows that the dye is adsorbed on the silver behenate and still present. The color tone of the dye adsorbed on silver behenate is more deepened than that of the dye itself. It is generally known that a dye adsorbed on silver halide shows a deepened color tone. Accordingly, it is believed that in the silver behenate obtained above the dye is adsorbed in the micelles formed by silver behenate.

The second method will be explained in more detail. An organic silver salt oxidizing agent is uniformly dispersed in a sensitizing dye solution and the oxidizing agent having the dye adsorbed thereon is separated, followed by washing with a solvent capable of dissolving the dye. The free sensitizing dye which is not adsorbed on the organic silver salt oxidizing agent is thereby removed. For example, the process for the preparation of silver behenate as the organic silver salt oxidizing agent may be practiced as follows. An equimolar amount of a sodium hydroxide solution is added to a warm ethanol solution of behenic acid to yield sodium behenate. Warm water is then added to dissolve the sodium behenate. An aqueous solution containing an equimolar amount of silver nitrate is dropwise added thereinto with stirring to yield white silver behenate. The obtained silver behenate is repeatedly washed with hot water and hot ethanol and then dried by heating under reduced pressure. The silver behenate is added to a solution of a sensitizing dye and uniformly dispersed by ball-milling. Subsequently this dispersion is separated into the colored silver behenate and the dye solution by centrifugation. For washing, the colored silver behenate is taken out and dispersed in a solvent containing no halogen and capable of dissolving the dye. The obtained dispersion is separated into the colored silver behenate and the dye solution by centrifugation. Such washing is repeated until the solvent layer is not colored. The silver behenate is colored by the dye. This colored silver behenate is taken out and dried. There is obtained the desired oxidizing agent containing the dye, substantially all of which is adsorbed thereon in the aggregate of micelles of silver behanate, without a free dye present.

A dry image forming material of this invention can be rendered photosensitive by preliminarily heating at 80° to 130° C. for about 1 to 5 seconds prior to exposure to light. As light sources suitable to image exposure, there can be employed various kinds of light sources such as a tungsten lamp, a fluorescent lamp, a xenon lamp, a mercury lamp, an iodine lamp, a CRT light source and the like. As methods for exposure to light, there can be employed, for example, photographing using a camera, projective exposure and contact exposure by putting a manuscript upon the image forming material. The amount of exposure to light is especially preferably about 10 to $10^2$ lx. · sec. After exposure to light, said image forming material is heat-developed by heating at 80° to 130° C. for about 1 to 60 second. The developing temperature is usually higher than the preliminary heating temperature and the developing time is usually longer than the preliminary heating time. In both the preliminary heating and the development, the higher the temperature, the shorter the time may be. The heating may be conducted using a hot plate, hot air, far infrared rays, high frequency induction heating and the like.

The remarkable advantage of this invention is that the production, storage and handling of the image forming material can be conducted under normal lighting conditions. Photosensitivity may be imparted by heating only just before the image formation, and therefore special precaution with respect to light exposure is not required in the preceding handling. According to this invention, only by dry processes including heating, image exposure and heat development, a visible image can be recorded selectively on a desired area of the image forming material without affecting adjacent areas because photosensitivity is imparted partially to the material on the desired area by selective heating. The material of this invention has therefore another advantage that required records can be added to the unrecorded areas each time when needed. Thus, up-dated informations may be additionally recorded thereon at need. A material of this invention also has a further advantage that when a sensitizing dye is contained in the material, an image of a colored manuscript can also be visibly recorded on the material by reflected or projected rays because the sensitizing dye widens the region of photosensitizing wave lengths and increases the sensitivity.

The following examples illustrate the invention in more detail but are not to be construed as limiting the scope thereof.

EXAMPLE 1

8.5 g. of behenic acid were dissolved in 150 ml. of ethanol at 60° C. with stirring, and a solution of 1 g. of sodium hydroxide in 100 ml. of water was dropwise added at 60° C. with stirring to form sodium behenate. 200 ml. of hot water of about 70° C. were then added and sodium behenate was completely dissolved at about 70° C. with continuation of stirring. Subsequently, an about 1/100 N aqueous nitric acid solution containing an equimolar amount, to that of the charged behenic acid, of silver nitrate was dropwise added at 70° C. with stirring. The dissolved sodium behenate was converted to insoluble silver behenate. The obtained silver behenate was recovered by filtration and repeatedly washed with hot water of about 80° C. and hot ethanol of about 70° C., followed by drying.

88 parts by weight of a 2:1 mixed solvent of methyl ethyl ketone (MEK) — toluene and 12 parts by weight of the above obtained silver behenate were ball-milled together for 24 hours. The dispersion of silver behenate was prepared. 6 g. of the silver behenate dispersion and a component I shown below were well mixed and the mixture was applied, using a blade, onto a 100μ polyethylene terephthalate film at a thickness of 100μ on a wet basis and dried.

Component I

| | |
|---|---|
| Polyvinyl butyral | 0.72 g. |
| MEK | 4 g. |
| Bis(p-methoxyphenyl)tellurium dibromide | 0.044 g. |
| Tetrabromobutane | 0.096 g. |
| Methanol solution of mercury acetate (5 mg./0.6 ml.) | 0.6 ml. |

A component II mixture shown below was further applied thereonto, using a blade, at a thickness of 100μ on a wet basis and dried. A dry image forming material A was thus prepared.

Component II

| | |
|---|---|
| Acetone | 8.3 g. |
| Cellulose acetate | 0.63 g. |
| Phthalazinone | 0.14 g. |
| 2,2'-Methylenebis(4-ethyl-6-t-butyl) phenol | 0.35 g. |

After the dry image forming material A was activated by heating at 100° C. for 3 seconds, it was exposed at a distance of 1 m for 1 second to light from a 150 W. xenon lamp (manufactured and sold by Ushio Denki Co., Ltd., Japan), with a 21-step steptablet (manufactured and sold by Eastman Kodak Co., Ltd., U.S.A.) laid upon said image forming material and heat-developed at 120° C. for 2 seconds. A clear black image without fog was obtained.

While, the dry image forming material A was, without activation by heating, exposed at a distance of 1 m for 1 minute to light from the 150 W. xenon lamp, with the 21 step steptablet laid upon said image forming material and heated at 120° C. for 10 seconds. But no image was obtained.

Further, after the prepared dry image forming material was allowed to stand for one month under room lighting conditions, it was heated, exposed to light and heat-developed in the same manner as mentioned above. A clear black image having the same photographic characteristics as those of the image obtained above was obtained.

COMPARATIVE EXAMPLE

Substantially the same procedures as described in Example 1 were repeated except that 0.022 g. of N-bromosuccinimide was used instead of bis(p-methoxyphenyl) tellurium dibromide in the component I of Example 1. A dry image forming material R was prepared. The image forming material R was heated, exposed to light and heat-developed in the same manner as described in Example 1. A clear black image was obtained but the sensitivity of the image forming material R was only one hundredth of that of the image forming material A of Example 1.

EXAMPLE 2 TO 14

Substantially the same procedures as described in Example 1 were repeated except that a compound shown in Table I was used instead of bis(p-methoxyphenyl) tellurium dibromide in the component I of Example 1. Dry image forming materials B, C, D, E, F, G, H, I, J, K, L, M and N were prepared. Images were formed by the same operations as described in Example 1. The sensitivity of the image forming material R of Comparative Example is evaluated as 10, and the relative value of sensitivity of each image forming material is also shown in Table I.

Table I

| Example | Image forming material | Compound | Sensitivity |
|---|---|---|---|
| 1 | A | Bis(p-methoxyphenyl) tellurium dibromide 0.044 g. Bis(p-methoxyphenyl) tellurium dibromide 0.028 g. | 1000 |
| 2 | B | Bis(p-methoxyphenyl) tellurium diiodide 0.014 g. | 2000 |
| 3 | C | Diphenylselenium dibromide 0.025 g. | 700 |
| 4 | D | Triphenylphosphine dibromoethylene 0.040 g. | 400 |
| 5 | E | Triphenylantimony dibromide 0.040 g. | 300 |
| 6 | F | Triphenylbismuth dibromide 0.040 g. | 400 |
| 7 | G | Triphenylarsine dibromide 0.035 g. | 300 |
| 8 | H | Triphenyllead bromide 0.03 g. | 150 |
| 9 | I | Triphenylgermanium bromide 0.03 g. | 100 |
| 10 | J | N-Bromosuccinimide 0.014 g. Bis(p-methoxyphenyl) telluride 0.014 g. | 700 |
| 11 | K | N-Bromosuccinimide 0.014 g. Triphenylantimony 0.014 g. | 200 |
| 12 | L | Bis(p-methoxyphenyl) tellurium dichloride 0.03 g. | 50 |
| 13 | M | Phenylethyltellurium | 50 |

Table I-continued

| Example | Image forming material | Compound | Sensitivity |
|---|---|---|---|
| | | dichloride 0.02 g. | |
| 14 | N | Bislauryltellurium diiodide 0.03 g. | 200 |
| Comparative Example | R | N-Bromosuccinimide 0.014 g. | 10 |

EXAMPLE 15

8.5 g. of behenic acid were dissolved in 150 ml. of ethanol at 60° C. with stirring, and a solution of 1 g. of sodium hydroxide in 100 ml. of water was dropwise added at 60° C. with stirring to form sodium behenate. 200 ml. of hot water were then added to and sodium behenate was completely dissolved in about 70° C. with continuation of stirring. To the resulting solution was added a solution of 10 mg. of a dye of the formula 2 as described in the specification in 50 ml. of ethanol. Subsequently, an about 1/100 N aqueous nitric acid solution containing an equimolar amount, to that of the charged behenic acid, of silver nitrate was dropwise added at about 70° C. with stirring. The dissolved sodium behenate was converted to insoluble silver behenate. The silver behenate was colored blue violet. The obtained colored silver behenate was recovered by filtration and repeatedly washed with hot water of about 80° C., hot ethanol of about 70° C. and MEK. Washing was repeated until the washings were not colored. Then, the silver behenate colored with the dye was dried. To 12 parts by weight of the thus prepared silver behenate having the dye adsorbed thereon were added 88 parts by weight of a 2:1 solution of MEK-toluene and the resulting mixture was ballmilled for 24 hours to give a dispersion. To 6 g. of the dispersion was added a component I shown in Example 1. The obtained composition was applied, using a blade, onto a 100μ polyethylene terephthalate film at a thickness of 100μ on a wet basis and dried. Thereafter, a component II mixture shown in Example 1 was further applied thereonto, using a blade, at a thickness of 100μ on a wet basis and dried. A dry image forming material O was prepared. On the other hand, for comparison, a dry image forming material P was prepared by the same procedures as described above except that 0.014 g. of N-bromosuccinimide was used instead of bis(p-methoxyphenyl)tellurium dibromide. The above-mentioned dry image forming materials O and P were activated by heating at 100° C. for 3 seconds, then exposed at a distance of 1 m for 1 second to light from the 150 W. xenon lamp, with a 21-step steptablet laid upon said image forming materials, and heat-developed at 120° C. for 2 seconds. The optical densities of the formed images were measured. On the other hand, the materials O and P were exposed to light through a Toshiba glass color filter VR-60, VO-55, VO50, VY-45 and UV-39 (trade names of glass color filters manufactured and sold by Tokyo Shibaura Denki Kabushiki Kaisha, Japan), the color filters being disposed alone, or in layers with a view to excluding a short wave length light of the half wave length, between the 150 W. xenon lamp and the 21-step steptablet; and from the results the upper limits of the regions of photosensitizing wave lengths were determined. Fogs, sensitivities and upper limits of photosensitizing wave length are shown in Table 2. Sensitivities are values relative to that of a dry image-forming material R evaluated as 10.

Table 2

| | O | P |
|---|---|---|
| Fog | 0.08 | 0.08 |
| Sensitivity | 1500 | 10 |
| Upper limit of photosensitizing wave length | >600 nm. | <450 nm. |

While the image forming material P wherein N-bormosuccinimide was used was not spectrally sensitized, the image forming material O of this invention was apparently spectrally sensitized.

EXAMPLE 16

Substantially the same procedures as described in Example 15 were repeated except that 10 mg. of a dye of the formula 21 as described in the specification were used instead of the dye of the formula 2, and 0.014 g. of N-bromosuccinimide and 0.044 g. of bis(p-methoxyphenyl) telluride were used instead of bis(p-methoxyphenyl)tellurium dibromide, to prepare an image forming material. The upper limit of photosensitizing wave length measured by the same method as described in Example 15 was 550 nm. Taking it into account that the region of photosensitizing wave lengths of the image forming material J containing no dye was <450 nm., it was apparent that the material of this Example was spectrally sensitized.

EXAMPLE 17

6 mg. of a dye of the formula 4 as described in the specification were dissolved in 80 ml. of MEK and 5.8 g. of silver behenate as obtained in Example 1 were mixed therewith. The mixture was ball-milled. After centrifugation of this obtained dispersion, the supernatant dye solution was removed by decantation. To the colored silver behenate remaining as the lower layer was again added MEK, followed by stirring and centrifugation. The supernatant dye solution was again removed by decantation. When this operation was repeated five times, the MEK of the upper layer after centrifugation was not any more colored. The silver behenate having the dye adsorbed thereon was obtained and dried. 12 Parts by weight of the silver behenate and 88 parts by weight of a 2:1 solution of MEK-toluene were mixed together and ball-milled for 24 hours to give a dispersion. An image forming material was prepared by the same procedures as described in Example 1 except that 6 g. of the dispersion were used. The region of photosensitizing wave lengths measured by the same method as described in Example 12 was >600 nm. It was apparent that this material was spectrally sensitized.

EXAMPLE 18

Substantially the same procedures as described in Example 15 were repeated except that 8.5 g. of stearic acid were used instead of behenic acid and 1.2 g. of sodium hydroxide were used. The silver stearate having the dye adsorbed thereon was obtained. A dry image forming material was prepared in the same manner as described in Example 1. Fog, sensitivity and the upper limit of photosensitizing wave length were examined by the same method as described in Example 15. The fog was 0.15, the sensitivity was 1500 (relative) and the upper limit of photosensitizing wave length was >600 nm.

EXAMPLE 19

Substantially the same procedures as described in Example 1 were repeated except that silver laurate, silver salt of benzotriazole or silver salt of 3-mercapto-4-phenyl-1,2,4-triazole was used instead of silver behenate. Dry image forming materials were prepared, and the image formed therefrom were clear black images without fog.

What is claimed is:

1. A heat-activatable dry image forming material comprising a) and organic silver salt oxidizing agent, b) a reducing agent, and c) a component adapted by heating to interact with the silver ion of (a) to form a photosensitive interaction product, said component consisting essentially of (i) a compound or (ii) a composition which comprises a halogen atom and an organic compound containing at least one element selected from the group consisting of germanium, tin, lead, phosphorus, arsenic, antimony, bismuth, selenium, tellurium and polonium, said compound (i) having the formula

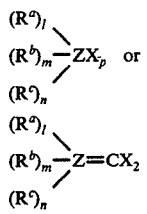

(I)

(II)

wherein $R^a$, $R^b$ and $R^c$ each independently is (1) a $C_1$–$C_{22}$ alkyl group, (2) a $C_1$–$C_{22}$ alkyl group substituted with a carboxyl group, a cyano group, a halogen atom, an aryl group, a hydroxyl group, an amino group, or a mono- or di-($C_1$–$C_5$ alkyl)amino group (3) a $C_5$–$C_6$ cycloalkyl group, (4) a $C_5$–$C_6$ cycloalkyl group substituted with a $C_1$–$C_5$ alkyl group, a $C_1$–$C_5$ alkoxy group, a halogen atom, a hydroxyl group, an amino group, or a mono- or di-($C_1$–$C_5$ alkyl)amino group, (5) an aryl group (6) an aryl group substituted with a $C_1$–$C_5$ alkyl group, a $C_1$–$C_5$ alkoxy group, a halogen atom, a hydroxyl group, an amino group, a mono- or di-($C_1$–$C_5$ alkyl) amino group, (7) a group of the formula $R_1$—$R_2$—, (8) a group of the formula $R_1$—C≡C—, (9) a group of the formula

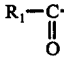

(10) a group of the formula

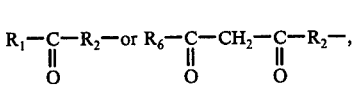

(11) a group of the formula $R_3$—M—, $(R_3)_2P$— or $(R_3)_3M$—, (12) a group of the formula —$R_4$—, —$R_5$—Y—$R_5$— or —$R_5$—$R_5$— which forms 5- or 6- membered ring with Z, wherein $R_1$ is a hydroxyl group, a $C_1$–$C_5$ alkoxy group, an unsubstituted or substituted 5- or 6- membered heterocyclic group having 16 or less carbon atoms and containing in its ring at least one of oxygen and nitrogen, or a group defined in (1) to (7) above; $R_2$ is a $C_1$–$C_4$ alkylene group; $R_3$ is a group as defined in (1) to (7) above; $R_4$ is a $C_4$–$C_5$ alkylene group unsubstituted or substituted with a $C_1$–$C_5$ alkyl group, a $C_1$–$C_5$ alkoxy group, a mono- or di-($C_1$–$C_5$ alkyl)amino group, an amino group or a hydroxyl group; $R_5$ is an ethylene group unsubstituted or substituted with a $C_1$–$C_5$ alkyl group, a $C_1$–$C_5$ alkoxy group, a mono- or di-($C_1$–$C_5$ alkyl)amino group, an amino group or a hydroxyl group, or a group of the formula

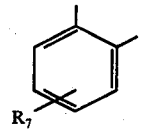

wherein $R_7$ is hydrogen, a $C_1$–$C_5$ alkyl group, a $C_1$–$C_5$ alkoxy group, a mono- or di-($C_1$–$C_5$ alkyl)amino group, an amino group, a hydroxyl group or a halogen atom; M is tellurium, germanium, tin, lead or silicon; P is phosphorus; Y is oxygen, nitrogen, sulfur, M or $=MX_2$; and $R_6$ is a $C_1$–$C_5$ alkyl group; X is chlorine, bromine, or iodine; Z is germanium, tin, lead, phosphorus, arsenic, antimony, bismuth, selenium, tellurium or polonium; and m and n are 0 or a positive integer, and l and p are positive integers provided that in the general formula (I) above, l+m+n+p=3, 4 or 5 and in the general formula (II) above, l+m+n+2=3, 4 or 5; said composition (ii) comprising a halogen atom-containing component and an organic component having the formula (III):

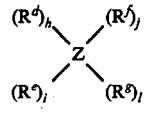

(III)

wherein $R^d$, $R^e$, $R^f$ and $R^g$, each independently is (1) a $C_1$–$C_{22}$ alkyl group, (2) a $C_1$–$C_{22}$ alkyl group substituted with a carboxyl group, a cyano group, a halogen group, an aryl group, a hydroxyl group, an amino group, or a mono- or di-($C_1$–$C_5$ alkyl)amino group (3) a $C_5$–$C_6$ cycloalkyl group, (4) a $C_5$–$C_6$ cycloalkyl group substituted with a $C_1$–$C_5$ alkyl group, a $C_1$–$C_5$ alkoxyl group, a halogen group, a hydroxyl group, an amino group, or a mono- or di-($C_1$–$C_5$ alkyl)amino group, (5) an aryl group (6) an aryl group substituted with a $C_1$-$C_5$ alkyl group, a $C_1$–$C_5$ alkoxy group, a halogen group, a hydroxyl group, an amino group, a mono- or di-($C_1$–$C_5$ alkyl) amino group, (7) a group of the formula $R_1$—$R_2$—, (8) a group of the formula $R_1$—C≡C—, (9) a group of the formula

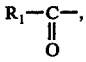

(10) a group of the formula

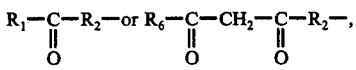

(11) a group of the formula $R_3$—M—, $(R_3)_2P$— or $(R_3)_3M$—, (12) a group of the formula —$R_4$—, —$R_5$—Y—$R_5$— or —$R_5$—$R_5$— which forms 5- or 6- membered ring with Z; and h is a positive integer, and i, j and k are 0 or a positive integer, provided that h+i+j+k=2, 3 or 4, there being no silver halide present in the material prior to said heating.

2. A dry image forming material as claimed in claim 1 wherein said component (c) is a compound (i) and is an organic tellurium halide.

3. A dry image forming material as claimed in claim 1 wherein l+m+n=2, 3 or 4 in the formula (I).

4. A dry image forming material as claimed in claim 1 wherein l+m+n=2 or 3 in the formula (II).

5. A dry image forming material as claimed in claim 1, wherein said organic silver salt oxidizing agent is a $C_{12}$-$C_{24}$ long chain fatty acid silver salt.

6. A dry image forming material as claimed in claim 1, wherein said component (c) is a composition (ii) and the halogen atom-containing component is an organic haloamide.

7. A dry image forming material as claimed in claim 6 wherein said halogen component constituting said composition is an organic haloamide compound which has the essential structure —CONX— or —$SO_2$NX— wherein X is chlorine, bromine or iodine.

8. A dry image forming material as claimed in claim 1 which further includes a sensitizing dye, substantially all of said sensitizing dye being adsorbed on the organic silver salt oxidizing agent.

9. A dry image forming material as claimed in claim 8 wherein said sensitizing dye is one obtained by effecting conversion of a precursor of the organic silver salt oxidizing agent in the presence of a sensitizing dye.

10. A dry image forming material as claimed in claim 8 wherein said sensitizing dye is one obtained by dispersing the organic silver salt oxidizing agent in a solution of a sensitizing dye and separating the organic silver salt agent having the dye adsorbed thereon, followed by washing and removing the non-adsorbed portion of the dye by a solvent containing no halogen and capable of dissolving said dye.

11. A dry image forming material as claimed in claim 8 wherein said sensitizing dye is a member selected from the group consisting of merocyanine, styryl and fluorescein type dyes which have a structure containing no halogen anion.

12. A dry image forming material as claimed in claim 8 wherein said sensitizing dye has a structure containing at least one of a carboxylic acid group, its salt and a higher alkyl group.

* * * * *